US011525217B2

(12) United States Patent
Bushhouse et al.

(10) Patent No.: US 11,525,217 B2
(45) Date of Patent: Dec. 13, 2022

(54) COATED PAPER AND PAPERBOARD STRUCTURES

(71) Applicant: WestRock MWV, LLC, Atlanta, GA (US)

(72) Inventors: Steven G. Bushhouse, Quinton, VA (US); Gary P. Fugitt, Rockville, VA (US); Scott E. Ginther, Moseley, VA (US)

(73) Assignee: WestRock MWV, LLC, Atlanta, GA (US)

( * ) Notice: Subject to any disclaimer, the term of this patent is extended or adjusted under 35 U.S.C. 154(b) by 0 days.

(21) Appl. No.: 17/101,099

(22) Filed: Nov. 23, 2020

(65) Prior Publication Data

US 2021/0180256 A1 Jun. 17, 2021

Related U.S. Application Data

(60) Provisional application No. 62/949,012, filed on Dec. 17, 2019.

(51) Int. Cl.

| | |
|---|---|
| ***D21H 19/40*** | (2006.01) |
| ***D21H 19/82*** | (2006.01) |
| ***D21H 19/38*** | (2006.01) |
| ***D21H 19/54*** | (2006.01) |

(52) U.S. Cl.

CPC ..... *D21H 19/822* (2013.01); *D21H 19/385* (2013.01); *D21H 19/40* (2013.01); *D21H 19/54* (2013.01)

(58) Field of Classification Search

CPC ..... D21H 19/50; D21H 19/822; D21H 19/54; D21H 19/40; D21H 19/36; D21H 27/10; D21H 19/385; D21H 19/52

USPC ..... 162/137

See application file for complete search history.

(56) References Cited

U.S. PATENT DOCUMENTS

| | | | | |
|---|---|---|---|---|
| 2,419,207 | A | 4/1947 | Fisher | |
| 8,216,381 | B2 | 7/2012 | Ladret et al. | |
| 9,080,290 | B2 | 7/2015 | Bloembergen et al. | |
| 9,157,187 | B2 | 10/2015 | Bloembergen | |
| 9,856,391 | B2 | 1/2018 | Welsch et al. | |
| 10,323,158 | B2 | 6/2019 | Mesanger et al. | |
| 2008/0206571 | A1 | 8/2008 | Berckmans et al. | |
| 2009/0314183 | A1 | 12/2009 | Tripathi | |
| 2010/0014373 | A1 | 1/2010 | Anand et al. | |
| 2010/0190012 | A1* | 7/2010 | Branston | D21H 19/44 428/512 |
| 2010/0261807 | A1 | 10/2010 | Laine et al. | |
| 2012/0309246 | A1 | 12/2012 | Tseitlin et al. | |
| 2013/0040158 | A1 | 2/2013 | Marakainen et al. | |
| 2015/0132594 | A1 | 5/2015 | Bouxin et al. | |
| 2017/0029549 | A1 | 2/2017 | Bloembergen et al. | |
| 2017/0081541 | A1 | 3/2017 | Makarainen et al. | |
| 2017/0328005 | A1 | 11/2017 | Parker et al. | |
| 2018/0044858 | A1 | 2/2018 | Peralba et al. | |
| 2018/0209098 | A1* | 7/2018 | Bushhouse | D21H 19/40 |

FOREIGN PATENT DOCUMENTS

| | | |
|---|---|---|
| CN | 106279447 | 1/2017 |
| JP | S56-398 | 1/1981 |
| JP | 2018-162551 | 10/2018 |
| WO | WO 2005/113894 | 12/2005 |
| WO | WO 2009/127598 | 10/2009 |
| WO | WO 2014/174205 | 10/2014 |
| WO | WO 2014/189999 | 11/2014 |

OTHER PUBLICATIONS

International Searching Authority: International Search Report and Written Opinion, Intl. App. No. PCT/US2020/061738 (dated Feb. 16, 2021).

Tappi Press Monograph: "Starch and Starch Products in Paper Coatings," (1990).

Montano et al: "The bio-touch: Increasing coating functionalities via biomass-derived components," *Surface and Coatings Technology*, 341, pp. 2-14 (2018). https://doi.org/10.1016/j.surfcoat.2017.10.073

Anthony et al: "Life cycle comparison of petroleum-and bio-based paper binding from distillers grain (DG)," *Industrial Crops and Products*, 96, 1-7 (2017). https://doi.org/10.1016/j.indcrop.2016.11.014.

Bergh et al: "Natural binders for paper coating: Starches, proteins and latices," *Fundam Papermaking Mater*, 1, pp. 139-207 (1997).

Bloembergen et al.: "The effects of biolatex binders on the dynamic water retention properties of paper coating formulations," vol. 75 (2014).

Bloembergen et al: "Biolatex binders for paper and paperboard applications," *Journal of Pulp and Paper Science*, 36(3), pp. 151-161 (2010).

Cheng et al: "Preparation and characterization of oxidized starch-graft-poly (styrene-butyl acrylate) latex via emulsion polymerization," *Journal of Polymer Engineering*, 34(7) (2014). https://doi.org/10,1515/polyeng-2014-0047.

Cheng et al: "Surfactant-free hybrid latexes from enzymatically hydrolyzed starch and poly (butyl acrylate-methyl methacrylate) for paper coating," *Process in Organic Coatings*, 118, pp. 40-47 (2018). https://doi.org/10.1016/j.porgoat.2018.01.015.

Cargill: "Coating Starches" https://www.cargill.com/bioindustrial/coating-starches.

Demchuk et al: "Versatile Platform for Controlling Properties of Plant Oil-Based Latex Polymer Networks," *ACS Sustainable Chemistry & Engineering*, 6(2), pp. 2780-2786 (2018). https://doi.org/10.1021/acssuschemeng.7b04462.

(Continued)

*Primary Examiner* — Mark Halpern

(74) *Attorney, Agent, or Firm* — Walters & Wasylyna LLC

(57) ABSTRACT

A coated paper or paperboard structure includes a paper or paperboard substrate and a basecoat applied to the paper or paperboard substrate to yield a basecoat outer surface. The basecoat includes a water-soluble polymer binder and pigment.

38 Claims, 9 Drawing Sheets

(56) References Cited

OTHER PUBLICATIONS

Du et al: "The influence of starch-based bio-latex on microstructure and surface properties of paper coating," *Process in Organic Coatings*, 116, pp. 51-56 (2018). https://doi.org/10.1016/j.porgcoat.2017.12.009.
Du et al: "Starch-based bio-latex redistribution during paper coating consolidation," *Process in Organic Coatings*, 106, pp. 155-162 (2017). https://doi/10.1016/j.porgoat.2017.02.016.
Du et al: "Effects of Starch on Latex Migration and on Paper Coating Properties," *Industrial & Engineering Chemistry Research*, 50(16), pp. 9781-9786 (2011). https://doi.org/10.1021/ie200807w.
Du et al: "The effects of water soluble polymers on paper coating consolidation," *Progress in Organic Coatings*, 77(4), pp. 908-912 (2014). https://doi.org/10.1016/j.porgcoat.2014.01.007.
Khwaldia et al: "Biopolymer Coatings on Paper Packaging Materials," *Comprehensive Reviews in Food Science and Technology*, 9, 82-91 (2010).
Laitinen: "Development of bio-based latexes for paper coating applications," Sundqvist (Ed.) "Research highlights in industrial biomaterials," pp. 76-78 (2012). http://www.vtt.fi/inf/pef/researchhighlights/2012/R2.pdf
Lee: "Manufacturing of Multi-layer Coated Paper with Eco-friendly Biobinder for Cost Saving," *Journal of Korea Technical Association of the Pulp and Paper Industry*, 47(5), pp. 127-133 (2015). https://doi.org/10.7584/ktappi.2015.47.5.127.
Moreno: "From fatty acid and lactone biobased monomers toward fully renewable polymer latexes," *Journal of Polymer Science Part A: Polymer Chemistry*, 36 (2014). https://doi.org/10.1002/pola.27422.
Moreno et al: "Eco-paints from bio-based fatty acid derivative latexes," *Progress in Organic Coatings*, 81, pp. 101-106 (2015). https://doi.org/10.1016/j.porgoat.2015.01.001.
Moreno et al: "Sustainable polymer latexes based on linoleic acid for coating applications," *Progress in Organic Coatings*, 77(11), pp. 1709-1714 (2014). https://doi.org/10.1016/porgoat.2014.05.016.
"Next generation of bio-based binders to be developed," (2013). https://phys.org/news/2013-03-bio-based-binders.html.
Oberndorfer et al: "Coating & print performance of biobased latex in European graphic papers," *Papercon*, pp. 2180-2195 (2011). https://pdfs.semanticsscholar.org/b993/0e01556c7e3706b64614d9a84e04b7d2665a.pdf.
Ortner et al: "Laccase modified lignosulfonates as novel binder in pigment based paper coating formulations," *Reactive & Functional Polymers*, 123, pp. 20-25 (2018). https://doi.org/10.1016/j.reactfunctpolym.2017.12.005.
Oviedo et al: "Rapeseed Proteins for Paperboard Coating," *Chemie Ingenieur Technik*, 86(8), pp. 1249-1259 (2014). https://doi.org/10.1002/cite.201300082.
Picchio et al: "Waterborne acrylic-casein latexes as eco-friendly binders for coatings," *Progress in Organic Coatings*, 88, pp. 8-16 (2015) https://doi.org/10.1016/j.porgcoat.2015.06.012.
Shen et al: "Biopolymers for surface engineering of paper-based products," *Cellulose*, 21(5), pp. 3145-3160 (2014). https://doi.org/10.1007/510570-014-0380-6.
Shin: "The Recent Development of New Pigment Binders," https://scholarworks.wmich.edu/dissertations.
Smeets et al: "Carbohydrate functionalized hybrid latex particles," *Carbohydrate Polymers*, 173, pp. 233-252 (2017). https://doi.org/10.1016/j.carbpol.2017.05.075.
Vaha-Nisi et al: "Aqueous dispersions from biodegradable/renewable polymers," (2010).
Wang et al: "Structure, Morphology and Properties of Benzyl Starch Nanocrystals," *Arabian Journal for Science and Engineering*, 39(9). pp. 6703-6710 (2014). https://doi.org/10.1007/513369-014-1201-9.
Zhou et al: "Effect of various cellulose derivatives on the properties of pigment coatings: a comparative study," *Digest Journal of Nanomaterials and Biostructures*, 9(1), pp. 301-315 (2014).

* cited by examiner

COATED PAPER AND PAPERBOARD STRUCTURES

PRIORITY

The present application claims priority from U.S. Ser. No. 62/949,012 filed on Dec. 17, 2019, the entire contents of which are incorporated herein by reference.

FIELD

The present application relates to the field of coated paper and coated paperboard structures.

BACKGROUND

Paper and paperboard substrates can be coated with one or more layers including latex binder and pigment. Compostability of such coated paper and paperboard substrates is limited by the presence of the latex binder. There is a need for paper and paperboard substrates that are more compostable and bio-based.

Accordingly, those skilled in the art continue with research and development in the field of coated paper and coated paperboard structures.

SUMMARY

In one embodiment, a coated paper or paperboard structure includes a paper or paperboard substrate and a basecoat applied to the paper or paperboard substrate to yield a basecoat outer surface. The basecoat includes a water-soluble polymer binder and pigment.

In another embodiment, a coated paper or paperboard structure includes a paper or paperboard substrate, a basecoat applied to the paper or paperboard substrate to yield a basecoat outer surface, and a topcoat applied over the basecoat to yield a topcoat outer surface. At least one of the basecoat and the topcoat includes a water-soluble polymer binder and a pigment.

In yet another embodiment, a coated paper or paperboard structure includes a paper or paperboard substrate and a coating applied to the paper or paperboard substrate to yield a coating outer surface. The coating includes a water-soluble polymer binder and a pigment.

Other embodiments of the disclosed coated paper and coated paperboard structures will become apparent from the following detailed description, the accompanying drawings and the appended Claims.

DETAILED DESCRIPTION

Figure 1:
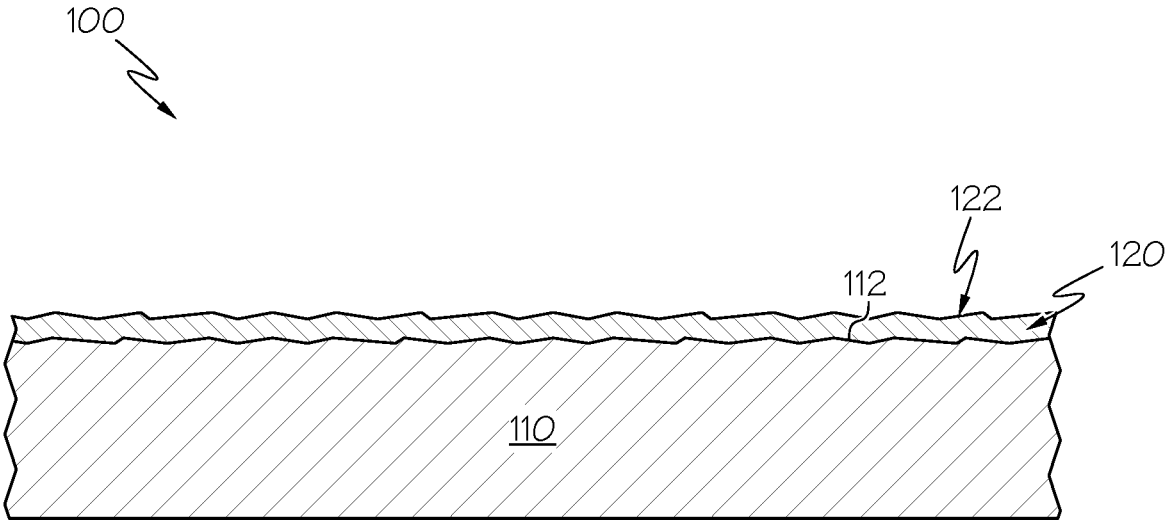
FIG. 1 is a cross sectional view of a coated paper or paperboard structure of the present description including a paper or paperboard substrate and a basecoat applied to the paper or paperboard substrate to yield a basecoat outer surface.

FIG. 1 is a cross sectional view of a coated paper or paperboard structure 100 according to a first embodiment of the present description. As shown in FIG. 1, the coated paper or paperboard structure 100 includes a paper or paperboard substrate 110 and a basecoat 120 applied to a surface 112 the paper or paperboard substrate 110 to yield a basecoat outer surface 122. According to the present description, the basecoat 120 includes a water-soluble polymer binder and a pigment.

The basecoat 120 is a coating intended to have at least one or more coatings applied over it in a final coated paper or paperboard product. The basecoat 120 is different from a topcoat and different from a coating of a single-coated product because the basecoat 120 is applied as an intermediate stage in the paperboard coating process. A basecoat 120 is not processed the same as a topcoat or a single-coated product. The basecoat 120 has one or more coatings applied over it in a final coated paper or paperboard product, whereas the topcoat or the single-coated product are subjected to post processing (e.g., calendering, printing, and converting).

The basecoat 120 may be applied to the paper or paperboard substrate 110 in any amount suitable for the intended use of the coated paper or paperboard structure 100. In an example, the basecoat 120 may be applied to the paper or paperboard substrate 110 at a coat weight, per side, in a range of 4 to 12 pounds per 3000 square feet of the paper or paperboard substrate 110. In another example, the basecoat 120 may be applied to the paper or paperboard substrate 110 at a coat weight, per side, in a range of 5 to 11 pounds per 3000 square feet of the paper or paperboard substrate 110. In yet another example, the basecoat 120 may be applied to the paper or paperboard substrate 110 at a coat weight, per side, in a range of 6 to 10 pounds per 3000 square feet of the paper or paperboard substrate 110.

In an aspect, the as-basecoated paper or paperboard substrate 110, i.e. the paper or paperboard substrate 110 upon being coated with the basecoat 120, may have a PPS10S roughness (Parker Print Surf roughness measured using 10 psi pressure with a soft backing) of 7μ or less. In another aspect, the as-basecoated paper or paperboard substrate 110 may have a PPS10S roughness of 6.5μ or less. In yet another aspect, the as-basecoated paper or paperboard substrate 110 may have a PPS10S roughness of 6μ or less. In yet another aspect, the as-basecoated paper or paperboard substrate 110 may have a PPS10S roughness of 5.5μ or less.

Thus, the as-basecoated paper or paperboard substrate 110 of the present description can enable modern sheet smoothness without necessitating any latex binder.

Figure 2:
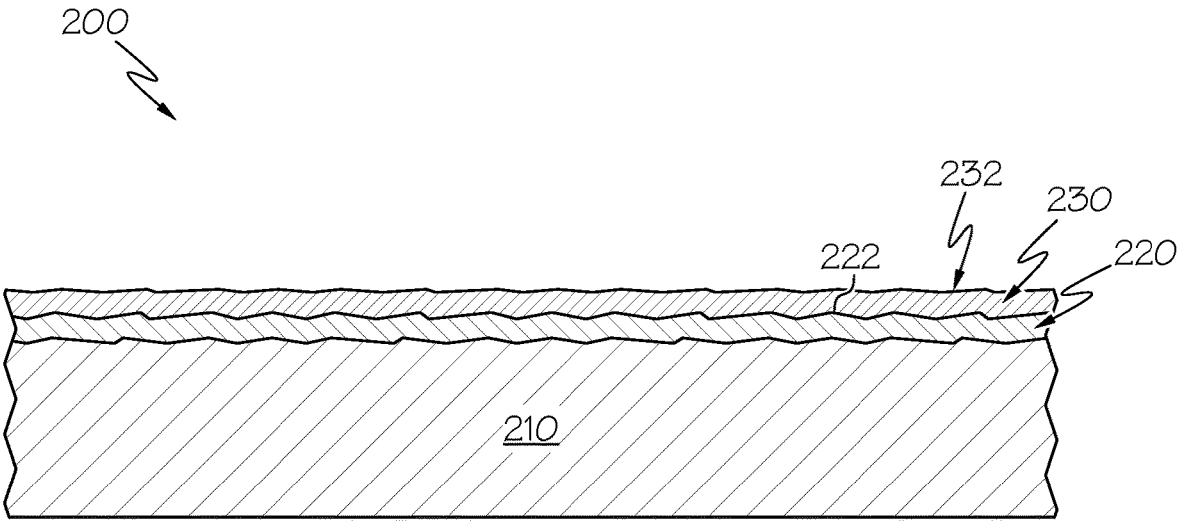
FIG. 2 is a cross sectional view of a coated paper or paperboard structure of the present description including a paper or paperboard substrate, a basecoat applied to the paper or paperboard substrate to yield a basecoat outer surface, and a topcoat applied over the basecoat to yield a topcoat outer surface.

FIG. 2 is a cross sectional view of a coated paper or paperboard structure 200 according to a second embodiment of the present description. As shown in FIG. 2, the coated paper or paperboard structure 200 includes a paper or paperboard substrate 210, a basecoat 220 applied to the paper or paperboard substrate 210 to yield a basecoat outer surface 222, and a topcoat 230 applied over the basecoat 220 to yield a topcoat outer surface 232.

In one aspect, as shown, the topcoat 230 may be applied directed on the basecoat outer surface 222 without any intermediate layers. In another aspect, one or more intermediate layers may be included between the basecoat 220 and the topcoat 230. In an example, a second basecoat may be included between the basecoat 220 and the topcoat 230. In another example, a barrier layer may be included between the basecoat 220 and the topcoat 230.

According to the present description, at least one of the basecoat 220 and the topcoat 230 includes a water-soluble polymer binder and a pigment. In one aspect, the basecoat 220 includes a water-soluble polymer binder and a pigment. In another aspect, the topcoat 230 includes a water-soluble polymer binder and a pigment. In yet another aspect, the basecoat 220 and the topcoat 230 include a water-soluble polymer binder and a pigment. The basecoat 220 and the topcoat 230 may have the same composition or may have different compositions.

The basecoat 220 may be applied to the paper or paperboard substrate 210 in any amount suitable for the intended use of the coated paper or paperboard structure 200. In an example, the basecoat 220 may be applied to the paper or paperboard substrate 210 at a coat weight, per side, in a range of 4 to 12 pounds per 3000 square feet of the paper or paperboard substrate 210. In another example, the basecoat 220 may be applied to the paper or paperboard substrate 210 at a coat weight, per side, in a range of 5 to 11 pounds per 3000 square feet of the paper or paperboard substrate 210. In yet another example, the basecoat 220 may be applied to the paper or paperboard substrate 210 at a coat weight, per side, in a range of 6 to 10 pounds per 3000 square feet of the paper or paperboard substrate 210.

In an aspect, the as-basecoated paper or paperboard substrate 210 may have a PPS10S roughness of 7μ or less. In another aspect, the as-basecoated paper or paperboard substrate 210 may have a PPS10S roughness of 6.5μ or less. In yet another aspect, the as-basecoated paper or paperboard substrate 210 may have a PPS10S roughness of 6μ or less. In yet another aspect, the as-basecoated paper or paperboard substrate 210 may have a PPS10S roughness of 5.5μ or less. Thus, the as-basecoated paper or paperboard substrate 210 of the present description can enable modern sheet smoothness without necessitating any latex binder.

The topcoat 230 may be applied to the paper or paperboard substrate 210 in any amount suitable for the intended use of the coated paper or paperboard structure 200. In an example, the topcoat 230 may be applied to the paper or paperboard substrate 210 at a coat weight, per side, in a range of 3 to 12 pounds per 3000 square feet of the paper or paperboard substrate 210. In another example, the topcoat 230 may be applied to the paper or paperboard substrate 210 at a coat weight, per side, in a range of 4 to 11 pounds per 3000 square feet of the paper or paperboard substrate 210. In yet another example, the topcoat 230 may be applied to the paper or paperboard substrate 210 at a coat weight, per side, in a range of 5 to 10 pounds per 3000 square feet of the paper or paperboard substrate 210.

In an aspect, the topcoated paper or paperboard substrate 210 may have a PPS10S roughness of 2.6μ or less after calendering. In another aspect, the topcoated paper or paperboard substrate 210 may have a PPS10S roughness of 2.3μ or less after calendering. In yet another aspect, the topcoated paper or paperboard substrate 210 may have a PPS10S roughness of 2.1μ or less after calendering. In yet another aspect, the topcoated paper or paperboard substrate 210 may have a PPS10S roughness of 1.9μ or less after calendering. Thus, the topcoated paper or paperboard substrate 210 of the present description can enable modern sheet smoothness without necessitating any latex binder.

In an aspect, the topcoated paper or paperboard substrate 210 may have an ink holdout after two minutes of less than 30% decrease in brightness. In another aspect, the topcoated paper or paperboard substrate 210 may have an ink holdout after two minutes of less than 25% decrease in brightness. In yet another aspect, the topcoated paper or paperboard substrate 210 may have an ink holdout after two minutes of less than 20% decrease in brightness. In yet another aspect, the topcoated paper or paperboard substrate 210 may have an ink holdout after two minutes of less than 15% decrease in brightness. Thus, the topcoated paper or paperboard substrate 210 of the present description can enable good smoothness and acceptable printing performance without necessitating any latex binder.

Figure 3:
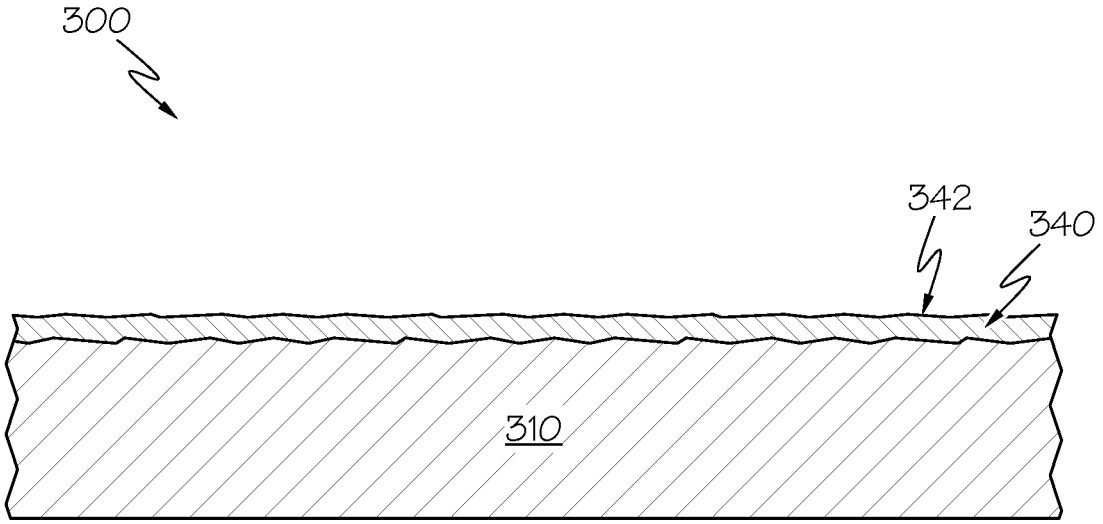
FIG. 3 is a cross sectional view of a coated paper or paperboard structure of the present description including a paper or paperboard substrate and a coating applied to the paper or paperboard substrate to yield a coating outer surface.

FIG. 3 is a cross sectional view of a coated paper or paperboard structure 300 according to a third embodiment of the present description. As shown in FIG. 3, the coated paper or paperboard structure 300 includes a paper or paperboard substrate 310 and a coating 340 applied to the paper or paperboard substrate 310 to yield a coating outer surface 342. According to the present description, the coating 340 includes a water-soluble polymer binder and a pigment.

The coating 340 is intended to yield a coating outer surface 342 of the coated paper or paperboard structure 300. The coating 340 is different from a basecoat. A basecoat is not processed the same as a single-coated product. A basecoat has one or more coatings applied over it in a final coated paper or paperboard product, whereas the single-coated product are subjected to post processing (e.g., calendering, printing, and converting).

The coating 340 may be applied to the paper or paperboard substrate 310 in any amount suitable for the intended use of the coated paper or paperboard structure 300. In an example, the coating 340 may be applied to the paper or paperboard substrate 310 at a coat weight, per side, in a range of 3 to 12 pounds per 3000 square feet of the paper or paperboard substrate 310. In another example, the coating 340 may be applied to the paper or paperboard substrate 310 at a coat weight, per side, in a range of 4 to 11 pounds per 3000 square feet of the paper or paperboard substrate 310. In yet another example, the coating 340 may be applied to the paper or paperboard substrate 310 at a coat weight, per side, in a range of 5 to 10 pounds per 3000 square feet of the paper or paperboard substrate 310.

In an aspect, the coated paper or paperboard substrate 310 may have a PPS10S roughness of 3.5μ or less after calendering. In another aspect, the coated paper or paperboard substrate 310 may have a PPS10S roughness of 3.0μ or less after calendering. In yet another aspect, the coated paper or paperboard substrate 310 may have a PPS10S roughness of 2.6μ or less after calendering. In yet another aspect, the coated paper or paperboard substrate 310 may have a PPS10S roughness of 2.3μ or less after calendering. In yet another aspect, the coated paper or paperboard substrate 310 may have a PPS10S roughness of 2.1μ or less after calendering. In yet another aspect, the coated paper or paperboard substrate 310 may have a PPS10S roughness of 1.9μ or less after calendering. Thus, the coated paper or paperboard substrate 310 of the present description can enable modern sheet smoothness without necessitating any latex binder.

In an aspect, the coated paper or paperboard substrate 310 may have an ink holdout after two minutes of less than 30% decrease in brightness. In another aspect, the coated paper or paperboard substrate 310 may have an ink holdout after two minutes of less than 25% decrease in brightness. In yet another aspect, the coated paper or paperboard substrate 310 may have an ink holdout after two minutes of less than 20% decrease in brightness. In yet another aspect, the coated paper or paperboard substrate 310 may have an ink holdout after two minutes of less than 15% decrease in brightness. Thus, the coated paper or paperboard substrate 310 of the present description can enable good smoothness and acceptable printing performance without necessitating any latex binder.

The coated paper or paperboard structures 100, 200, and 300 may include one or more of the following additional features.

The paper or paperboard substrates of the coated paper or paperboard structures 100, 200, and 300 may be selected from any paper or paperboard substrate suitable for applying a coating thereon.

The paper or paperboard substrate may be bleached or unbleached.

The paper or paperboard substrate may include any grade of paper or paperboard suitable for applying a coating thereon. The paper or paperboard substrate may include, for example, corrugating medium, linerboard, solid bleached sulfate (SBS), folding boxboard (FBB), coated unbleached kraft (CUK), and recycled paper or paperboard.

The paper or paperboard substrate may include any uncoated basis weight suitable for applying a coating thereon. The paper or paperboard substrate may have, for example, an uncoated basis weight of 20 pounds per 3000 $ft^2$ or more. For example, the paper or paperboard substrate may have an uncoated basis weight in the range of 20 pounds per 3000 $ft^2$ to about 400 pounds per 3000 $ft^2$. In a specific example, the paper or paperboard substrate may have an uncoated basis weight in the range of 20 pounds per 3000 $ft^2$ to about 60 pounds per 3000 $ft^2$. In another specific example, the paper or paperboard substrate may have an uncoated basis weight in the range of 60 pounds per 3000 $ft^2$ to about 120 pounds per 3000 $ft^2$. In another specific example, the paper or paperboard substrate may have an uncoated basis weight in the range of 100 pounds per 3000 $ft^2$ to about 250 pounds per 3000 $ft^2$. In another specific example, the paper or paperboard substrate may have an uncoated basis weight in the range of 120 pounds per 3000 $ft^2$ to about 140 pounds per 3000 $ft^2$.

The paper or paperboard substrate may include any thickness suitable for applying a coating thereon. The paper or paperboard substrate may have, for example, an average caliper thickness of 0.002 inch or greater (2 point or greater). In a specific example, the paper or paperboard substrate may have an average caliper thickness in the range of 0.002 inch to 0.035 inch (2 point to 35 point). In another specific example, the paper or paperboard substrate may have an average caliper thickness in the range of 0.008 inch to 0.026 inch (8 point to 26 point).

In an aspect, the basecoat 120, the basecoat 220, the topcoat 230, and the coating 340 may optionally include one or more additional soluble binders with the water-soluble polymer binder. In another aspect, the basecoat 120, the basecoat 220, the topcoat 230, and the coating 340 may include no binders other than the water-soluble polymer binder. In a particular aspect, the basecoat 120, basecoat 220, topcoat 230, or coating 340 may be latex-free.

The water-soluble polymer binder may consist of a single water-soluble polymer binder composition or may include a blend of water-soluble polymer binder compositions.

In an aspect, the water-soluble polymer binder include one or more natural water-soluble polymer binders, which are derived from a natural source. In another aspect, the water-soluble polymer binder consist of the one or more natural water-soluble polymer binders.

An advantage of the coated paper or paperboard structure with no latex binder using all-natural binders may be highly compostable.

In an example, the water-soluble polymer binder may include a protein. The protein may be animal-based protein or a plant-based protein. The animal-based protein may be in the form of, for example, keratin and collagen. The animal-based protein may be in the form of, for example, gelatin. The plant-based protein may be derived from, for example, soy.

In an example, the water-soluble polymer binder may include a carbohydrate. The carbohydrate may be in the form of cellulose derivative. The carbohydrate may be in the form of starch. The starch may be derived from, for example, corn or potatoes.

In an example, the water-soluble polymer binder may include a natural gum. The natural gum may include, for example, a natural botanical gum. The natural botanical gum may include, for example, a natural botanical gum derived from the woody element of plants. In another example, the natural botanical gum may include a natural botanical gum derived from seed coatings. In a specific example, the water-soluble polymer binder may include a natural botanical gum in the form of one or more of alginate, cellulose derivatives, carrageenan, guar gum and xanthan. In another specific example, the water-soluble polymer binder may include a natural botanical gum in the form of carboxymethyl cellulose (CMC).

The pigment of the basecoat 120, the basecoat 220, the topcoat 230, and/or or the coating 340 may include one or more of the following features.

The pigment may have a single composition or may be a blend of pigment.

In an aspect, the pigment may include an inorganic pigment.

In an aspect, the pigment may include calcium carbonate. The calcium carbonate may include, for example, ground calcium carbonate. The ground calcium carbonate may be, for example, fine ground calcium carbonate, wherein more than 75 percent of the calcium carbonate particles are less than 2 microns in diameter. The ground calcium carbonate may be, for example, course ground calcium carbonate, wherein 45 to 75 percent of the calcium carbonate particles are less than 2 microns in diameter. The ground calcium carbonate may be, for example, extra course ground calcium carbonate, wherein less than 45 percent of the calcium carbonate particles are less than 2 microns in diameter.

In an aspect, the pigment may include calcium carbonate having a median particle diameter of 1 micron or more. In another aspect, the pigment may include calcium carbonate having a median particle diameter of 1.5 micron or more. In yet another aspect, the pigment may include calcium carbonate having a median particle diameter of 3 micron or more. The median particle diameter is the median particle diameter as measured by a sedimentation-based method, i.e. the SediGraph by Micromeritics.

The pigment may include kaolin clay. The kaolin clay may include a platy clay.

In an aspect, the platy clay may have an aspect ratio in excess of 40:1. In another aspect, the platy clay may have an aspect ratio in excess of 50:1. In yet another aspect, the platy clay may have an aspect ratio in excess of 70:1. In yet another aspect, the platy clay may have an aspect ratio in excess of 90:1.

In an aspect, the platy clay may have a median particle diameter of 4 microns or more. In another aspect, the platy clay may have a median particle diameter of 10 microns or more. In yet another aspect, the platy clay may have a median particle diameter of 13 microns or more.

The pigment may include a pigment blend. The pigment blend may include, for example, a blend of calcium carbonate and a platy clay. The amounts of calcium carbonate and platy clay are not limited. In an example, the calcium carbonate may be included in amount of between 10 percent by weight of the pigment blend and 85 percent by weight of the pigment blend.

The amounts of water-soluble polymer binder and pigment in the basecoat 120, basecoat 220, topcoat 230, or coating 340 are not limited. In an example, a ratio of the water-soluble polymer binder to the pigment may be less than 1:1 by weight. In another example, a ratio of the water-soluble polymer binder to the pigment may be in a range of 1:2 to 1:20 by weight. In yet another example, a ratio of the water-soluble polymer binder to the pigment may be in a range of 1:3 to 1:7 by weight. In yet another example, a ratio of the water-soluble polymer binder to the pigment may be in a range of 1:4 to 1:5 by weight.

The basecoat 120, basecoat 220, topcoat 230, or coating 340 may include additives other than the water-soluble polymer binder and the pigment to improve or enhance their performance.

In an aspect, the basecoat 120, basecoat 220, topcoat 230, or coating 340 may include a crosslinker (also referred to as insolubilizer). The crosslinker causes the water-soluble polymer binder molecules to bond with each other upon drying which gives the respective coatings greater water resistance.

In an example, the crosslinker may include a glyoxal-based crosslinker. In another example, the crosslinker may include a zirconium-based crosslinker. In yet another example, the crosslinker may include a glyoxal-based crosslinker and a zirconium-based crosslinker. The amount of the crosslinker is not limited. In an example, the crosslinker may be included in an amount of 1% to 20% by weight of the amount of water-soluble polymer binder. In another example, the crosslinker may be included in an amount of 1% to 10% by weight of the amount of water-soluble polymer binder. In another example, the crosslinker may be included in an amount of 4% to 8% by weight of the amount of water-soluble polymer binder. In yet another example, the crosslinker may be included in an amount of 3% to 6% by weight of the amount of water-soluble polymer binder.

In another aspect, the basecoat 120, basecoat 220, topcoat 230, or coating 340 may include a humectant (water loving material) that functions as a plasticizer for the water-soluble polymer binder by retaining water in the dried coating.

In an example, the humectant may include a humectant in form of glycerin. In another example, the humectant may include a humectant in form of sorbitol. In yet another example, the humectant may include a humectant in form of glycerin and sorbitol. The amount of the humectant is not limited. In an example, the humectant may be included in an amount of 1% to 30% by weight of the amount of water-soluble polymer binder. In another example, the humectant may be included in an amount of 5% to 30% by weight of the amount of water-soluble polymer binder. In yet another example, the humectant may be included in an amount of 5% to 15% by weight of the amount of water-soluble polymer binder. In yet another example, the humectant may be included in an amount of 15% to 25% by weight of the amount of water-soluble polymer binder. In yet another example, the humectant may be included in an amount of 25% to 30% by weight of the amount of water-soluble polymer binder.

Experimental Examples

Experimental examples of the present description have found that basecoats and topcoats formed from water-soluble polymer binders and pigments surprisingly yield good smoothness and acceptable printing performance without necessitating any latex binder, enabling for the production of smooth coated paper or paperboard structures that would be compostable and bio-based.

Materials

Hydrocarb 60—a coarse ground calcium carbonate pigment supplied by Omya

Hydrocarb 90—a fine ground calcium carbonate pigment supplied by Omya

XP6170—A hyperplaty clay pigment with a shape factor of about 70 provided by Imerys Kaofine 90—A fine kaolin clay pigment provided by Thiele Rhoplex P308—A styrene-acrylic latex binder from Dow Ethylex 2015—An ethylated starch binder provided by Tate & Lyle Sequarex 755—a glyoxal-based crosslinker provided by Omnova Glycerin—a vegetable glycerin humectant from Amazon Sorbitol—a humectant from ADM Coating Compositions Basecoat compositions BC1 to BC11 were formulated with the weight ratios of respective components, i.e. Hydrocarb 60, XP6170, Rhoplex P308, Ethylex 2015, Glycerin, Sorbitol, and Sequarez 755, as shown in Table 1 below. The percent solids of the basecoat compositions were determined by measuring the weight difference in the basecoat compositions before and after drying. Basecoat composition BC1 represents a conventional basecoat composition. Basecoat compositions BC2 to BC11 are experimental basecoat compositions of the present description.

Topcoat compositions TC1 to TC5 were formulated with the weight ratios of respective components, i.e. Hydrocarb 90, Kaofine 90, Rhoplex P308, Ethylex 2015, Glycerin, Sorbitol, and Sequarez 755, as shown in Table 2 below. The percent solids of the topcoat compositions were determined by measuring the weight difference in the topcoat compositions before and after drying. Topcoat composition TC1 represents a conventional topcoat composition. Topcoat compositions TC2 to TC5 are experimental topcoat compositions of the present description.

As shown in Table 1, there were two different pigment systems used for the basecoat compositions. The first pigment system comprised a coarse ground calcium carbonate, which is a typical basecoat pigment. The second pigment system comprised blend of coarse ground calcium carbonate and hyperplaty clay. The reference basecoat composition BC1, considered to be conventional, had coarse ground calcium carbonate with a latex binder. All other basecoat compositions had water-soluble polymer binders.

The coating compositions included coating compositions with and without crosslinker, and with different levels of humectant. Crosslinker addition was limited by Food and Drug Administration (FDA) regulations, and the addition level was based on the amount of water-soluble polymer binder added, not the total coating. All coating compositions that contained a crosslinker had an addition level of 6% dry-on-dry based on the amount of water-soluble polymer binder. There were two types of FDA approved crosslinkers considered. In the experiments, a glyoxal-based crosslinker was used, and the maximum for this was 6% based on the amount of water-soluble polymer binder. There were many different humectants that could be chosen. In the experiments, it was decided to limit selection to bio-based materials, in particular, glycerin (also called glycerol) and sorbitol. The addition levels of humectants were based on the amount of water-soluble polymer binder, not on the total coating. Humectant levels of 0, 10, 20 and 30%, based on weight, of the water-soluble polymer binder were tested.

TABLE 1

| Basecoat | BC1 | BC2 | BC3 | BC4 | BC5 | BC6 | BC7 | BC8 | BC9 | BC10 | BC11 |
|---|---|---|---|---|---|---|---|---|---|---|---|
| Hydrocarb 60 | 100 | 100 | 100 | 100 | 100 | 50 | 50 | 50 | 50 | 50 | 50 |
| XP6170 | 0 | 0 | 0 | 0 | 0 | 50 | 50 | 50 | 50 | 50 | 50 |
| Rhoplex P308 | 18 | 0 | 0 | 0 | 0 | 0 | 0 | 0 | 0 | 0 | 0 |
| Ethylex 2015 | 0 | 20 | 20 | 20 | 20 | 25 | 25 | 25 | 25 | 25 | 25 |
| Glycerin | 0 | 0 | 2 | 4 | 6 | 0 | 2.5 | 5 | 7.5 | 0 | 5 |
| Sorbitol | 0 | 0 | 0 | 0 | 0 | 0 | 0 | 0 | 0 | 3.5 | 0 |
| Sequarez 755 | 0 | 1.2 | 1.2 | 1.2 | 1.2 | 1.5 | 1.5 | 1.5 | 1.5 | 1.5 | 0 |
| Percent Solids | 68 | 61.4 | 61.9 | 62.5 | 63.1 | 54.7 | 55.7 | 57.3 | 56.4 | 55.8 | 57.4 |

TABLE 2

| | TC1 | TC2 | TC3 | TC4 | TC5 |
|---|---|---|---|---|---|
| Hydrocarb 90 | 75 | 75 | 75 | 75 | 75 |
| Kaofine 90 | 25 | 25 | 25 | 25 | 25 |
| Rhoplex P308 | 12 | 0 | 0 | 0 | 0 |
| Ethylex 2015 | 0 | 12 | 12 | 12 | 12 |
| Glycerin | 0 | 0 | 2.4 | 0 | 2.4 |
| Sorbitol | 0 | 0 | 0 | 2.4 | 0 |
| Sequarez 755 | 0 | 0.72 | 0.72 | 0.72 | 0 |
| Percent Solids | 65 | 65 | 65 | 65 | 65 |

Application of and Testing of Coating Compositions

Coating compositions BC1 to BC11 and TC1 to TC5 were applied using pilot coating equipment. All coatings were applied to a 12"-wide at 400 fpm using a bent blade configuration. The substrate was a solid bleached sulfate (SBS) paperboard with a basis weight of about 150lb/3000 $ft^2$ and a caliper of about 0.013". Each basecoat composition BC1 to BC11 was applied at three different coat weights, as shown in Table 3. Extended footage was run for each formula and coat weight combination. Samples were taken from each of these conditions for testing, and the remaining footage was used to produce topcoated prototypes. Basecoated samples were tested as-is without any additional processing. All testing was performed under TAPPI standard conditions. Print Surf roughness measurements were conducted using 10 psi pressure with a soft backing (PPS10S). The results are displayed in Table 3.

TABLE 3

| Composition | Coat Weight | PPS10S |
|---|---|---|
| BC1 | 6.1 | 6.13 |
| BC1 | 7.9 | 6.08 |
| BC1 | 9.7 | 5.95 |
| BC2 | 6.3 | 6.51 |
| BC2 | 7.1 | 6.53 |
| BC2 | 8.5 | 6.59 |
| BC3 | 6.7 | 6.92 |
| BC3 | 7.5 | 6.89 |
| BC3 | 8.7 | 6.78 |
| BC4 | 6.6 | 6.61 |
| BC4 | 7.4 | 6.65 |
| BC4 | 8.5 | 6.60 |
| BC5 | 6.3 | 6.62 |
| BC5 | 7.6 | 6.28 |
| BC5 | 8.7 | 6.30 |
| BC6 | 7.4 | 5.90 |
| BC6 | 8.9 | 5.62 |
| BC6 | 9.7 | 5.54 |
| BC7 | 7.1 | 5.64 |
| BC7 | 7.9 | 5.67 |

TABLE 3-continued

| Composition | Coat Weight | PPS10S |
|---|---|---|
| BC7 | 9.0 | 5.55 |
| BC8 | 6.5 | 5.77 |
| BC8 | 8.1 | 5.71 |
| BC8 | 9.5 | 5.57 |
| BC9 | 7.0 | 5.87 |
| BC9 | 8.1 | 5.74 |
| BC9 | 9.7 | 5.68 |
| BC10 | 6.7 | 5.98 |
| BC10 | 7.8 | 5.97 |
| BC10 | 9.3 | 5.93 |
| BC11 | 6.6 | 5.54 |
| BC11 | 8.0 | 5.61 |
| BC11 | 9.2 | 5.58 |

Referring to Table 4, basecoats were covered one of the topcoat compositions TC1 to TC5. For each basecoat/topcoat combination a range of topcoat weights were applied to create double coated prototypes having a range of basecoat/topcoat coat weights. The double coated samples were cut into sheets. These sheets were calendered using a single-nip soft roll calender. The soft roll had a Shore D hardness of 85. Sheets were calendered through one nip at 300 fpm, 225° F. and 150 pli pressure. Only calendered topcoated samples were tested. Print Surf roughness measurements were conducted using 10 psi pressure with a soft backing (PPS10S). The results are displayed in Table 4.

TABLE 4

| Composition | TC | BC Ct Weight | TC Ct Weight | Cal PPS10S |
|---|---|---|---|---|
| BC1 | TC1 | 7.9 | 5.4 | 2.32 |
| BC1 | TC1 | 7.9 | 6.4 | 2.17 |
| BC1 | TC1 | 7.9 | 8.6 | 2.16 |
| BC2 | TC3 | 8.5 | 5.2 | 2.44 |
| BC2 | TC3 | 8.5 | 6.2 | 2.46 |
| BC2 | TC3 | 8.5 | 7.2 | 2.40 |
| BC2 | TC3 | 8.5 | 9.3 | 2.32 |
| BC4 | TC3 | 8.5 | 5.7 | 2.52 |
| BC4 | TC3 | 8.5 | 6.9 | 2.52 |
| BC4 | TC3 | 8.5 | 8.6 | 2.41 |
| BC9 | TC2 | 8.2 | 5.9 | 1.99 |
| BC9 | TC2 | 8.2 | 7.3 | 2.09 |
| BC9 | TC2 | 8.2 | 8.9 | 2.10 |
| BC11 | TC3 | 8.0 | 6.1 | 2.05 |
| BC11 | TC3 | 8.0 | 7.2 | 2.17 |
| BC11 | TC3 | 8.0 | 8.8 | 2.21 |
| BC10 | TC4 | 7.8 | 5.2 | 2.20 |
| BC10 | TC4 | 7.8 | 6.8 | 2.22 |
| BC10 | TC4 | 7.8 | 7.6 | 2.23 |
| BC10 | TC4 | 7.8 | 9.3 | 2.24 |
| BC11 | TC5 | 8.0 | 6.1 | 2.10 |
| BC11 | TC5 | 8.0 | 7.0 | 2.15 |
| BC11 | TC5 | 8.0 | 8.9 | 2.14 |
| BC8 | TC5 | 8.1 | 5.1 | 2.09 |
| BC8 | TC5 | 8.1 | 6.3 | 2.12 |
| BC8 | TC5 | 8.1 | 7.9 | 2.08 |
| BC1 | TC1 | 9.7 | 5.1 | 2.36 |
| BC1 | TC1 | 9.7 | 6.3 | 2.09 |
| BC1 | TC1 | 9.7 | 9.4 | 2.02 |
| BC6 | TC2 | 10.2 | 5.3 | 1.86 |
| BC6 | TC2 | 10.2 | 7.0 | 1.94 |
| BC6 | TC2 | 10.2 | 8.1 | 2.00 |
| BC9 | TC2 | 9.7 | 5.4 | 1.97 |
| BC9 | TC2 | 9.7 | 6.2 | 1.97 |
| BC9 | TC2 | 9.7 | 8.9 | 2.08 |
| BC8 | TC5 | 9.3 | 4.9 | 2.04 |
| BC8 | TC5 | 9.3 | 6.2 | 2.03 |
| BC8 | TC5 | 9.3 | 7.1 | 2.06 |
| BC8 | TC5 | 9.3 | 9.4 | 2.09 |

Analysis of Roughness Results

The present description includes, but is not limited to, the following findings.

Figure 4:
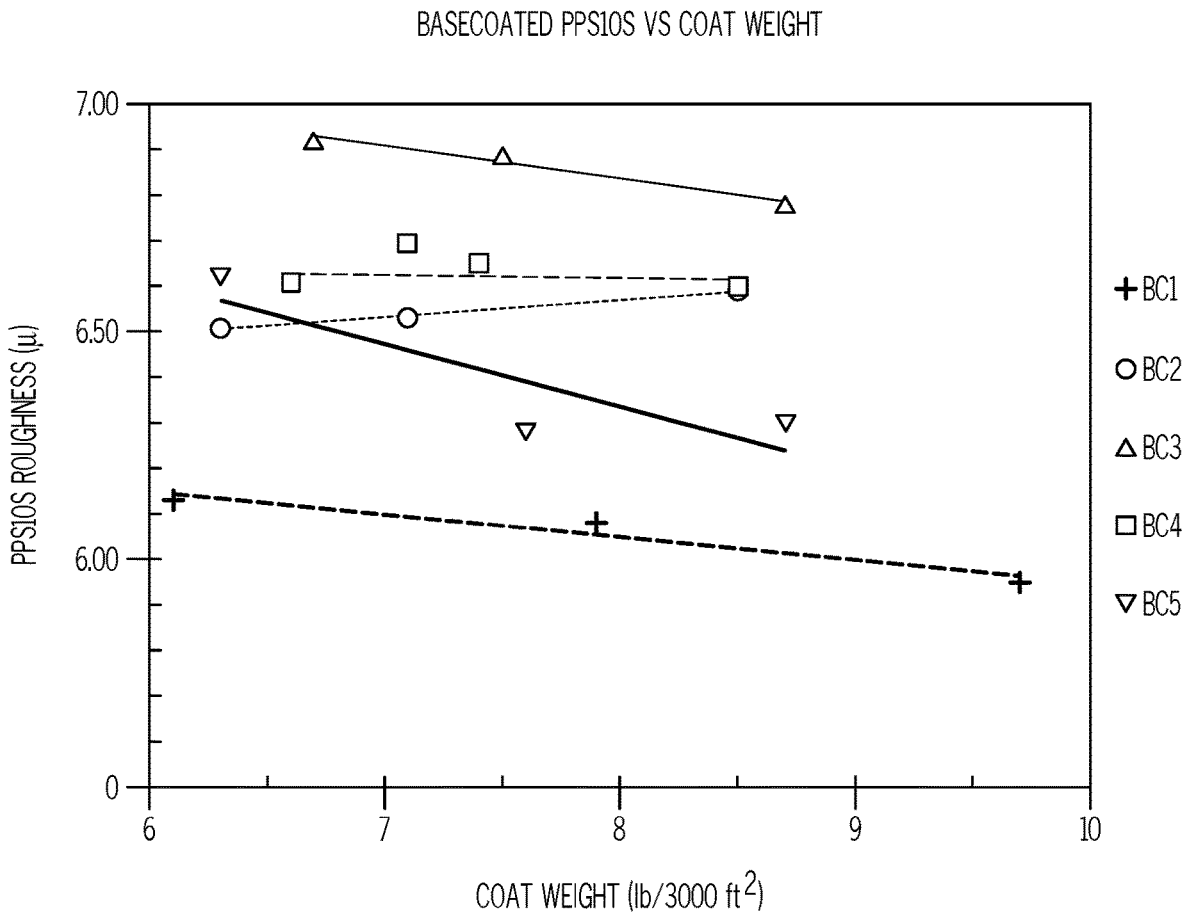
FIG. 4 is a plot of roughness of basecoated-only samples over a range of basecoat weights.

FIG. 4 plots roughness (PPS10S) of basecoated-only control sample BC1 vs. basecoated-only samples BC2 to BC5 over a range of basecoat weights. As demonstrated, if latex is simply replaced with water-soluble polymer binder, regardless of the presence or level of glycerin, the roughness increases.

Figure 5:
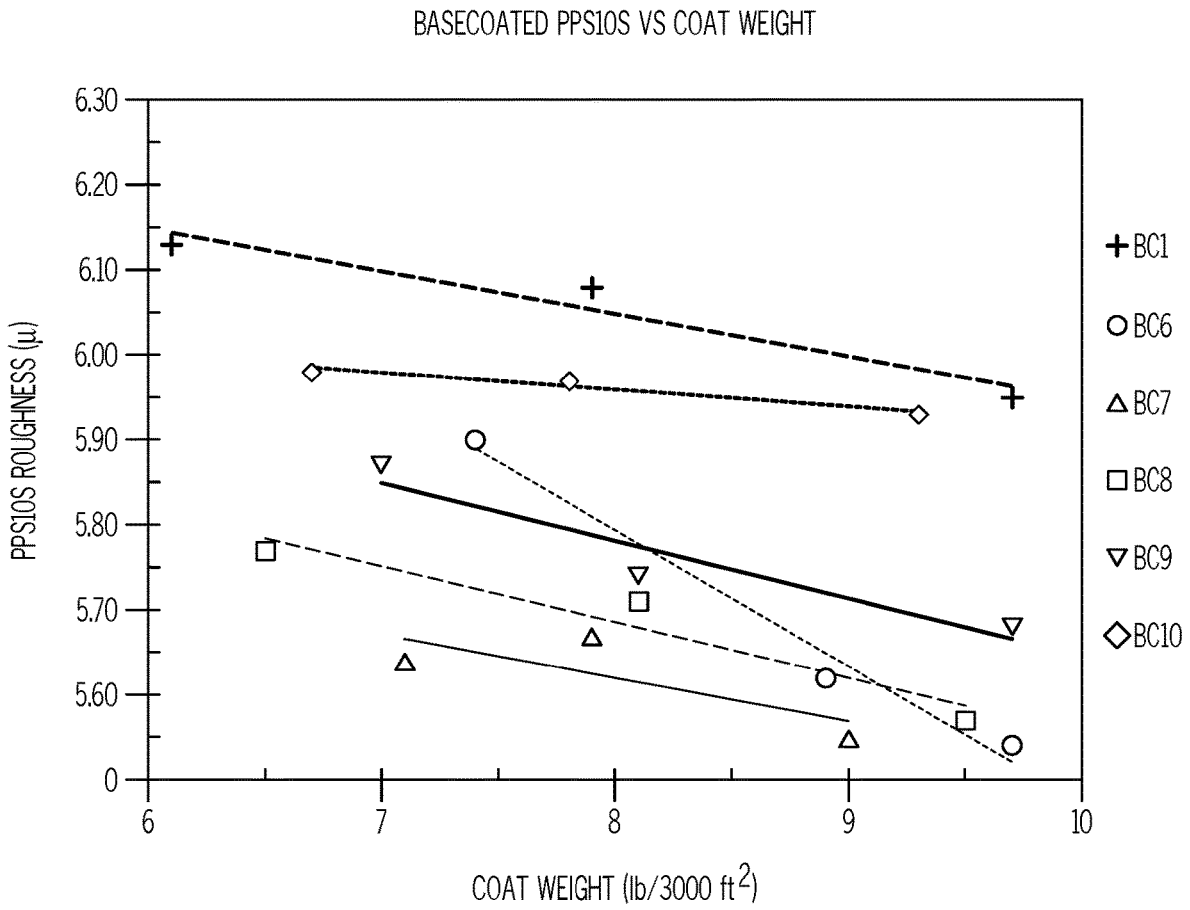
FIG. 5 is another plot of roughness of basecoated-only samples over a range of basecoat weights.

FIG. 5 plots roughness (PPS10S) of basecoated-only control sample BC1 vs. basecoated-only samples BC6 to BC10 over a range of basecoat weights. As demonstrated, by using a pigmented system containing a hyperplaty clay, roughness of the water-soluble polymer binder samples is reduced relative to the latex control sample BC1. These examples represent two different humectants and a range of humectant levels. Thus, the blend of coarse ground calcium carbonate and hyperplaty clay was shown to have advantages over the all-carbonate pigment system.

Figure 6:
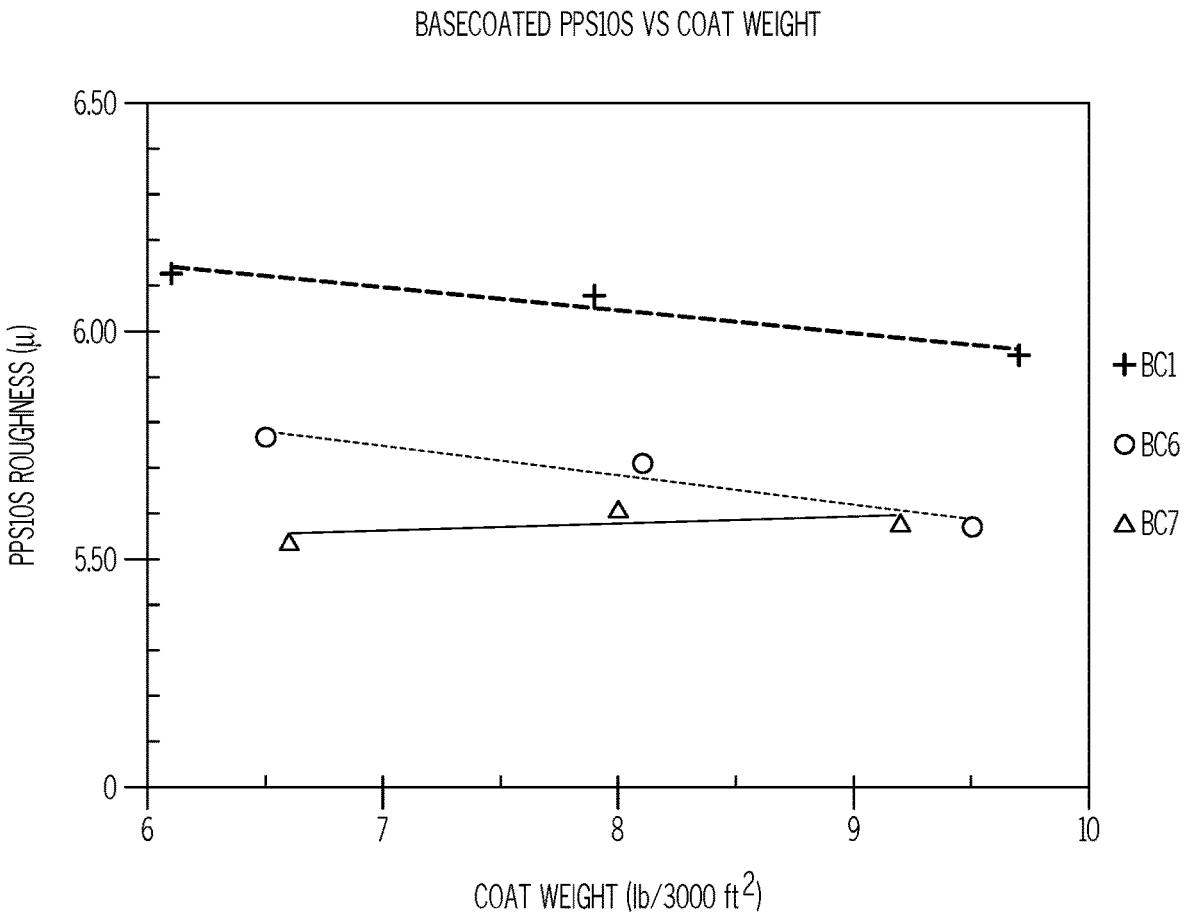
FIG. 6 is another plot of roughness of basecoated-only samples over a range of basecoat weights.

FIG. 6 plots roughness (PPS10S) of basecoated-only control sample BC1 vs. basecoated-only samples BC8 to BC11 over a range of basecoat weights. As demonstrated, the improvement in roughness when using the blend of coarse ground calcium carbonate and hyperplaty clay occurs bot with and without crosslinker.

Figure 7:
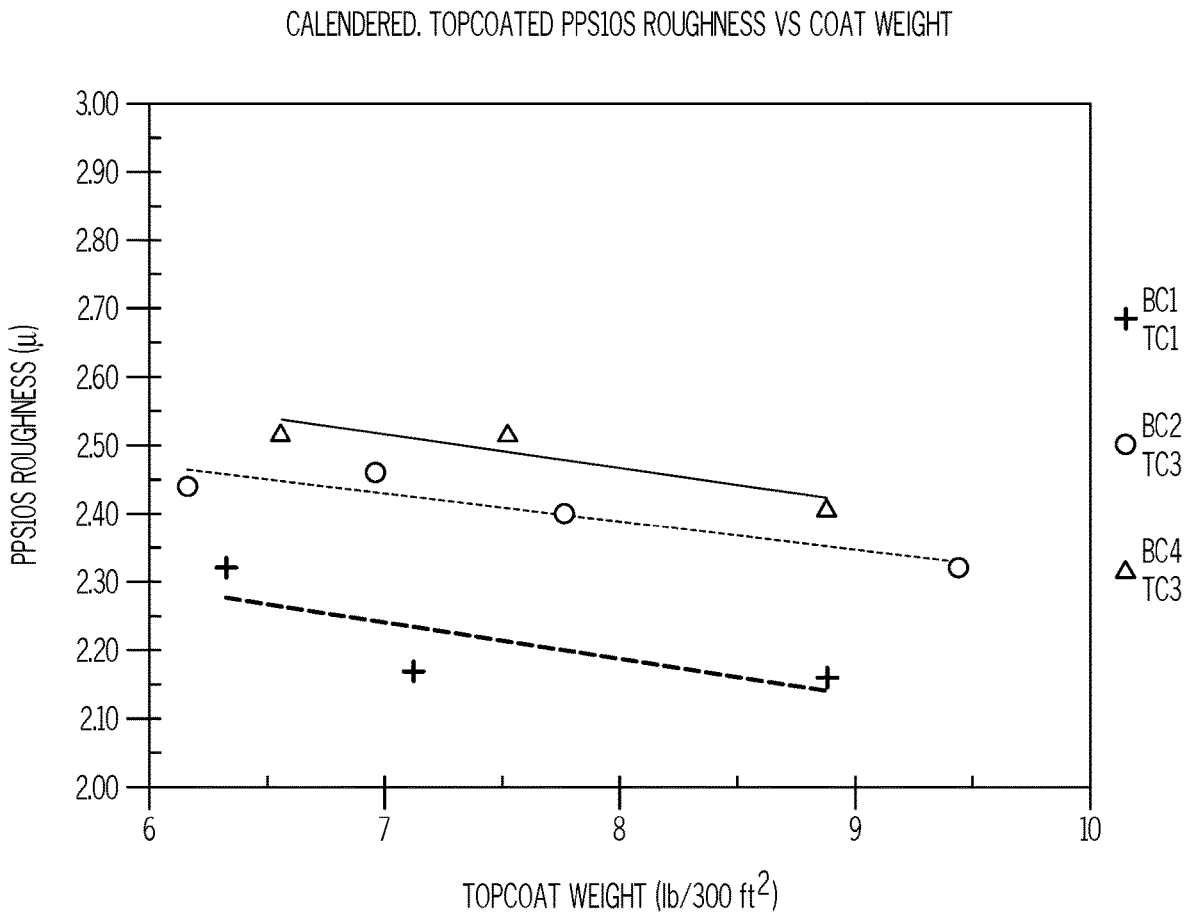
FIG. 7 is a plot of roughness after calendering of basecoated and topcoated samples over a range of basecoat weights.

FIG. 7 plots roughness (PPS10S) after calendering of basecoated and topcoated control sample BC1/TC1 vs. basecoated and topcoated samples BC2/TC3 and BC4/TC3 over a range of basecoat weights. These are topcoated samples which all have all-carbonate basecoats. BC1/TC1 is the combination of a typical latex basecoat with a typical latex topcoat which serves as a reference. BC2/TC3 and BC4/TC3 are combinations of basecoats of the present description with topcoats of the present description. Samples with a basecoat weight closest to 7.9 lb were selected for topcoating. The resulting coatings for BC2/TC3 and BC4/TC3 have acceptable surface roughness which is comparable the reference.

Figure 8:
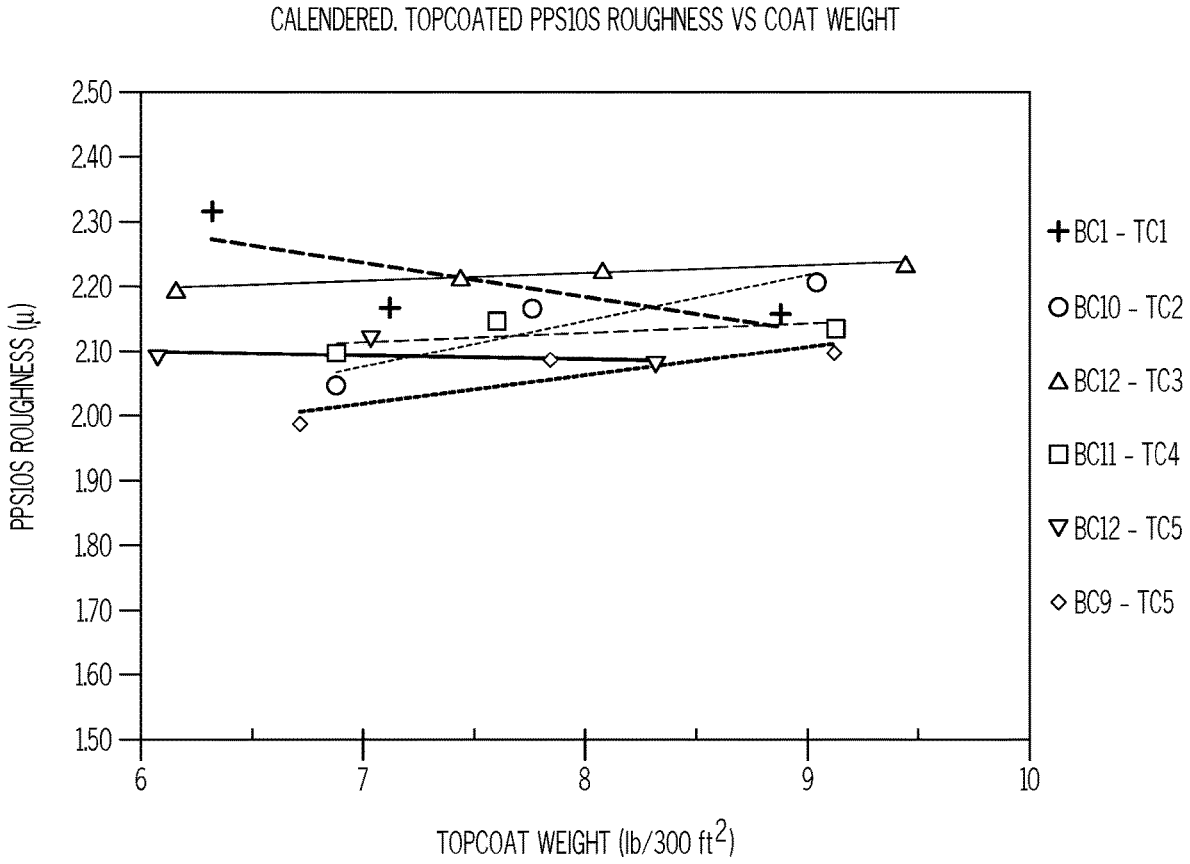
FIG. 8 is another plot of roughness after calendering of basecoated and topcoated samples over a range of basecoat weights.

FIG. 8 plots roughness (PPS10S) after calendering of basecoated and topcoated control sample BC1/TC1 vs. basecoated and topcoated samples of the present description. These basecoated and topcoated samples of the present description coatings all use a 50/50 blend of coarse ground calcium carbonate and hyperplaty clay in the basecoat. The level of water-soluble polymer binder was held constant. Only the humectant levels were varied. Samples with a basecoat weight closest to 8 lb were used for topcoating. These samples demonstrate a wide range of combinations of the basecoats and topcoats of the present description that give equal or slightly better roughness than the reference basecoated and topcoated control sample BC1/TC1. Thus, by using hyperplaty clay in the basecoat, it was possible to make double coated samples without latex that have equal or better roughness values than the latex control sample.

Figure 9:
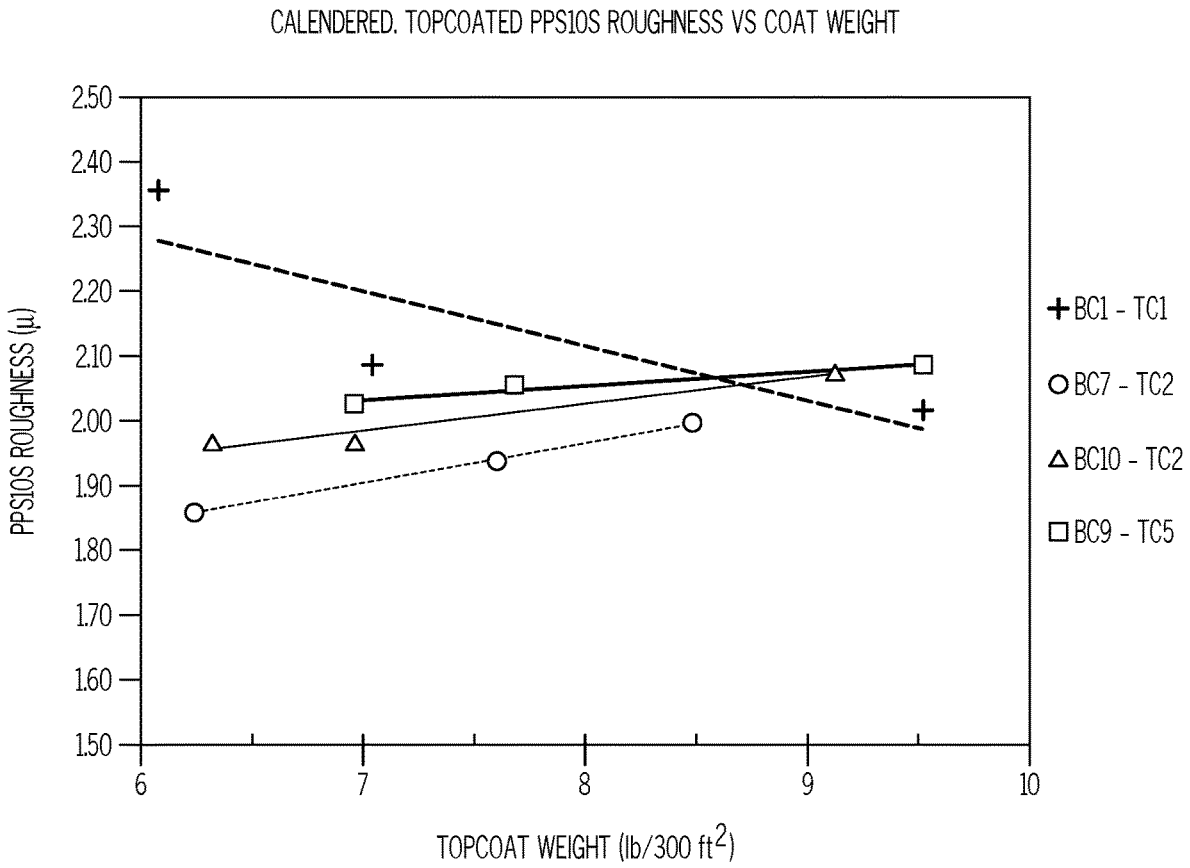
FIG. 9 is another plot of roughness after calendering of basecoated and topcoated samples over a range of basecoat weights.

FIG. 9 plots roughness (PPS10S) after calendering of basecoated and topcoated control sample BC1/TC1 vs. basecoated and topcoated samples of the present description. These basecoated and topcoated samples of the present description coatings all use a 50/50 blend of coarse ground calcium carbonate and hyperplaty clay in the basecoat. Samples with a basecoat weight closest to 9.7 lb were used for topcoating. Compared to the reference control sample BC1/TC1, the basecoated and topcoated samples of the present description have equal or better roughness values, regardless of the presence or absence of crosslinker.

Evaluation of Printing Performance

One method to evaluate the printing performance of coated paper is to measure the ink receptivity also known as ink holdout. In this test, a red high viscosity oil was applied in excess to the sample surface and allowed to sit for 2 minutes. After 2 minutes, the excess was thoroughly wiped away and the remaining stain was analyzed. The amount of ink remaining in the surface was measured as the decrease in brightness due to ink staining. This was reported as the percent decrease in brightness. The higher the number, the more ink was absorbed instead of being held out on the surface. The ink stain results are shown in Table 5. Tested samples included those that had both basecoat and topcoat weights of 8.51b. In some cases where a topcoat weight was not available, two samples with topcoat weights that bracket 8.5 were used. Table 5 shows that all of the samples with basecoat and topcoat of the present description, which include a water-soluble polymer binder and a pigment, have significantly improved ink holdout compared to the reference control sample BC1/TC1.

TABLE 5

| Basecoat | Topcoat | Basecoat Weight | Topcoat Weight | Uninked Brightness | Inked Brightness | Delta Brightness | % Drop in Brightness |
|---|---|---|---|---|---|---|---|
| BC1 | TC1 | 7.9 | 8.6 | 89.2 | 60.2 | 29 | 32.5 |
| BC2 | TC3 | 8.5 | 7.2 | 89.3 | 74.2 | 15.1 | 16.9 |
| BC2 | TC3 | 8.5 | 9.3 | 88.9 | 75.9 | 13 | 14.6 |
| BC5 | TC3 | 8.7 | 7.4 | 89.1 | 73.6 | 15.5 | 17.4 |
| BC5 | TC3 | 8.7 | 9.7 | 88.9 | 76.2 | 12.7 | 14.3 |
| BC6 | TC2 | 8.9 | 7.7 | 87.3 | 73.3 | 14 | 16.0 |
| BC6 | TC2 | 8.9 | 9.5 | 87.2 | 75.3 | 11.9 | 13.6 |
| BC9 | TC2 | 8.2 | 8.9 | 87.7 | 75.1 | 12.6 | 14.4 |
| BC8 | TC3 | 8.1 | 8.3 | 87.5 | 74.4 | 13.1 | 15.0 |
| BC11 | TC5 | 8.0 | 8.9 | 87.7 | 75.9 | 11.8 | 13.5 |

Although various embodiments of the disclosed coated paper and coated paperboard structures have been shown and described, modifications may occur to those skilled in the art upon reading the specification. The present application includes such modifications and is limited only by the scope of the Claims.

What is claimed is:

1. A coated paper or paperboard structure comprising:
a paper or paperboard substrate; and
a coating applied to the paper or paperboard substrate to yield a coating outer surface, the coating comprising:
water-soluble polymer binder; and
pigment,
wherein the coating is latex-free, and
wherein the coating further comprises a crosslinker in an amount of 1% to 10% by weight of the amount of water-soluble polymer binder.

2. The coated paper or paperboard structure of claim 1 wherein the water-soluble polymer binder consists of one or more natural water-soluble polymers.

3. The coated paper or paperboard structure of claim 1 wherein the pigment includes a pigment blend of calcium carbonate and a platy clay, wherein the calcium carbonate comprises at least 10 percent by weight of the pigment blend and at most 85 percent by weight of the pigment blend.

4. The coated paper or paperboard structure of claim 1 wherein a ratio of the water-soluble polymer binder to the pigment is less than 1:1 by weight.

5. The coated paper or paperboard structure of claim 1 wherein the coating further comprises a crosslinker in an amount of 2% to 8% by weight of the amount of water-soluble polymer binder.

6. The coated paper or paperboard structure of claim 1 wherein the coating further comprises a humectant in an amount of 1% to 30% by weight of the amount of water-soluble polymer binder.

7. The coated paper or paperboard structure of claim 1 wherein the coating is applied to the paper or paperboard substrate at a coat weight, per side, in a range of 3 to 12 pounds per 3000 square feet of the paper or paperboard substrate.

8. The coated paper or paperboard structure of claim 1 wherein the coated paper or paperboard substrate is calendered and has a PPS10S roughness of 3.5μ or less after calendering.

9. The coated paper or paperboard structure of claim 1 wherein the coated paper or paperboard substrate has an ink holdout after two minutes of less than 30% decrease in brightness.

10. The coated paper or paperboard structure of claim 1 wherein the coating further comprises a humectant.

11. The coated paper or paperboard structure of claim 1 wherein the water-soluble polymer binder includes a protein.

12. The coated paper or paperboard structure of claim 1 wherein the water-soluble polymer binder includes a carbohydrate.

13. The coated paper or paperboard structure of claim 1 wherein the water-soluble polymer binder includes a polysaccharide.

14. The coated paper or paperboard structure of claim 1 wherein the water-soluble polymer binder includes a natural gum.

15. The coated paper or paperboard structure of claim 1 wherein the pigment includes an inorganic pigment.

16. The coated paper or paperboard structure of claim 1 wherein the pigment includes calcium carbonate.

17. The coated paper or paperboard structure of claim 1 wherein the pigment includes ground calcium carbonate.

18. The coated paper or paperboard structure of claim 1 wherein the pigment includes fine ground calcium carbonate, wherein more than 75 percent of the calcium carbonate particles are less than 2 microns in diameter.

19. The coated paper or paperboard structure of claim 1 wherein the pigment includes course ground calcium carbonate, wherein 45 to 75 percent of the calcium carbonate particles are less than 2 microns in diameter.

20. The coated paper or paperboard structure of claim 1 wherein the pigment includes extra course ground calcium carbonate, wherein less than 45 percent of the calcium carbonate particles are less than 2 microns in diameter.

21. The coated paper or paperboard structure of claim 1 wherein the pigment includes calcium carbonate having a median particle diameter of 1 micron or more.

22. The coated paper or paperboard structure of claim 1 wherein the pigment includes a kaolin clay.

23. The coated paper or paperboard structure of claim 1 wherein the pigment includes a platy clay.

24. The coated paper or paperboard structure of claim 1 wherein the pigment includes a platy clay having an aspect ratio in excess of 40:1.

25. The coated paper or paperboard structure of claim 1 wherein the pigment includes a platy clay having a median particle diameter of 4 microns or more.

26. The coated paper or paperboard structure of claim 1 wherein the pigment includes a pigment blend of calcium carbonate and a platy clay.

27. The coated paper or paperboard structure of claim 1 wherein a ratio of the water-soluble polymer binder to the pigment is in a range of 1:2 to 1:40 by weight.

28. The coated paper or paperboard structure of claim 1 wherein a ratio of the water-soluble polymer binder to the pigment is in a range of 1:4 to 1:10 by weight.

29. The coated paper or paperboard structure of claim 1 wherein the coating further comprises a crosslinker in an amount of 3% to 6% by weight of the amount of water-soluble polymer binder.

30. The coated paper or paperboard structure of claim 1 wherein the coating further comprises a humectant in form of one or more of glycerin and sorbitol.

31. The coated paper or paperboard structure of claim 1 wherein the coating further comprises a humectant in an amount of 5% to 30% by weight of the amount of water-soluble polymer binder.

32. The coated paper or paperboard structure of claim 1 wherein the coating further comprises a humectant in an amount of 5% to 15% by weight of the amount of water-soluble polymer binder.

33. The coated paper or paperboard structure of claim 1 wherein the coating further comprises a humectant in an amount of 15% to 25% by weight of the amount of water-soluble polymer binder.

34. The coated paper or paperboard structure of claim 1 wherein the coating further comprises a humectant in an amount of 25% to 30% by weight of the amount of water-soluble polymer binder.

35. The coated paper or paperboard structure of claim 1 wherein the coating is applied to the paper or paperboard substrate at a coat weight, per side, in a range of 4 to 11 pounds per 3000 square feet of the paper or paperboard substrate.

36. The coated paper or paperboard structure of claim 1 wherein the coating is applied to the paper or paperboard substrate at a coat weight, per side, in a range of 5 to 10 pounds per 3000 square feet of the paper or paperboard substrate.

37. The coated paper or paperboard structure of claim 1 wherein the coated paper or paperboard substrate has a PPS10S roughness of 3.0μ or less after calendering.

38. The coated paper or paperboard structure of claim 1 wherein the coated paper or paperboard substrate has an ink holdout after two minutes of less than 25% decrease in brightness.

* * * * *